United States Patent [19]

Lorenz et al.

[11] 4,396,371

[45] Aug. 2, 1983

[54] DEVICE FOR CONTROLLING THE AIR SUPPLY TO A GAS BURNER

[75] Inventors: Werner Lorenz; Hans Sommers, both of Essen; Heinz Bathke, Borken, all of Fed. Rep. of Germany

[73] Assignees: Gaswarme-Institut e.V.; Ruhrgas AG, both of Essen, Fed. Rep. of Germany

[21] Appl. No.: 240,864

[22] Filed: Mar. 5, 1981

[30] Foreign Application Priority Data

Mar. 15, 1980 [DE] Fed. Rep. of Germany ..... 3010014

[51] Int. Cl.[3] ..... G05D 11/02

[52] U.S. Cl. ..... 431/90; 236/15 BD; 431/12

[58] Field of Search ..... 236/15 BD, 1 A; 431/12, 431/90

[56] References Cited

U.S. PATENT DOCUMENTS 1,814,163 7/1931 Irwin ..... 236/1 A 1,885,433 11/1932 Hall ..... 236/1 A 1,981,602 11/1934 Levey et al. ..... 431/90

*Primary Examiner*—William E. Wayner

*Attorney, Agent, or Firm*—Karl F. Ross; Herbert Dubno

[57] ABSTRACT

A burner having an air intake at atmospheric pressure, a gas (fuel) supply line and a combustion chamber in which gas from the latter line burns in the presence of atmospheric air drawn in from the intake, is provided with a swingable or rotatable flap-type valve member which controls the volume rate of flow of the air to the combustion site. According to the invention, the position of the valve member is controlled by a parameter generated by the air stream and in response to the pressure in the gas supply line to maintain the air factor (ratio of air to gas) substantially constant. To this end a membrane type pressure detector responds to the pressure in the gas supply line and is connected by a mechanical force transmission mechanism to the flap or other valve element.

2 Claims, 5 Drawing Figures

DEVICE FOR CONTROLLING THE AIR SUPPLY TO A GAS BURNER

FIELD OF THE INVENTION

Our present invention relates to gas combustion devices and, more particularly, to the combustion of gas with air drawn from the ambient atmosphere at the atmospheric pressure at an intake of the apparatus. Specifically, the invention deals with a device for controlling the supply of air to the combustion site of a gas burning installation.

BACKGROUND OF THE INVENTION

Gas burning installations which are supplied with a gaseous fuel, e.g. natural gas-methane, propane, butane, generally comprise a gas supply line terminating in at least one nozzle from which the fuel gas is discharged, a combustion zone downstream of this nozzle, a duct connecting the combustion zone and/or the region of the nozzle with an air intake port at which this duct takes the combustion sustaining gas, generally air, at ambient pressure from the ambient atmosphere, and a flue, chimney or stack which the combustion products discharges.

It is desirable to maintain the air factor, i.e. the molar, weight or volume ratio of air to gas, substantially constant during the combustion process and at a predetermined optimum level designed to maximize the degree of combustion of the gas and the heat value produced thereby.

It has been proposed, in this connection, to provide a control element in the path of the air to the combustion site which is capable of varying the flow cross section and hence the rate at which the air is delivered to the combustion site. In a conventional system of this type, this flow control element is actuated by a force which is a parameter of the air flow, i.e. is a function thereof.

Atmospheric fuel gas installations are, for the purposes of this description, combustion units operating with the gas as a fuel and in which the combustion is carried out for heating purposes or for other purposes utilizing generally an open combustion chamber to which the air is supplied via a duct of the aforementioned type without blowers or other forced air mechanisms upstream of the intake. The air can be drawn from the intake through the duct by the natural draft of the system.

In a system in which the air control element responds to a force which is a function of the air flow parameter, generally, and as described in German patent document—Utility Model DE-GM No. 79 08 061, the only forces acting upon this element are those of unavoidable friction, gravity and the force which is a function of the air flow parameter mentioned previously.

Such devices have been found to be effective with most gas consumers of the aforedescribed type, since such units generally have constant loads.

For multistage burner installations, burner installations the outputs of which are varied frequently or to a high degree, and other systems in which generally constant conditions cannot be maintained, the control by such an element of the air flow to the combustion site does not maintain the air/fuel gas ratio constant or sufficiently constant. For example, in many cases the air/fuel gas ratio decreases as the fuel gas throughput is increased because conventional devices of the type described tend to maintain the air flow rate constant and independent from the fuel gas throughput. This variation of the ratio, of course, adversely affects the efficiency of the apparatus and inevitably means that the efficiency at partial or low loading will be significantly less than the efficiency at full load or under nominal operating conditions of the apparatus.

It has been proposed (see the *Institution of Gas Engineers,* Communication 108, 1979, page 17, FIG. 10) to provide air-displacement type burner installations, using a blower which drives the combustion air through a duct, to control the air factor (ratio of combustion air to fuel gas) so as to maintain this ratio practically constant under all operating conditions by providing a membrane control unit. This unit is responsive to the pressure of the air ahead of the combustion site and controls a valve for the fuel gas so as to maintain the ratio constant.

However, this arrangement is not appropriate of being applied to atmospheric air combustion installations with varying load requirements and variable flue drafts.

OBJECTS OF THE INVENTION

It is the principal object of the present invention to provide an improved control system for an atmospheric pressure gas-burning installation whereby the disadvantages of earlier systems are avoided and the air/fuel ratio can be maintained practically constant under all operating conditions including varying load and flue draft.

Another object of this invention is to provide a gas-burning unit of increased efficiency and output which is of simple and reliable construction.

A further object of the invention is to provide an arrangement which enables an atmospheric pressure gas-burning installation, that the throughput of the combustion air can be varied in proportion to the throughput of fuel gas, and that that the ratio can be maintained practically constant under all operating conditions.

SUMMARY OF THE INVENTION

The gas combustion system of the invention comprises a gas-burning site, a conduit for delivering a fuel gas to this site and is provided, if desired, with one or more nozzles, an air duct having an intake at atmospheric pressure for delivering combustion air to this site, a flow control member for regulating the volume rate of flow of the combustion air from the intake to the burning site, this flow control member being affected by a force generated by a parameter of the combustion air stream and, in addition, means responsive to the fuel gas pressure in the conduit, and means connected with the pressure-responsive means for applying a force to the flow control member which is such a function of the gas pressure that the ratio of combustion air to fuel gas is maintained substantially constant.

According to the invention, therefore, a sensor is provided for the fuel gas pressure upstream the nozzle which is coupled, preferably by a mechanical transmission, with the flow control member to position the latter in accordance with the fuel gas pressure.

The sensor can respond to the static pressure of the gas or to a pressure difference generated by the gas flow. This pressure or pressure difference of the fuel gas directly or indirectly generates a signal for controlling the air flow in accordance with the invention.

The term "signal" is used herein in the general sense to mean any output which can effect a response. In the case of a direct mechanical link between the sensor and the flow control member, this signal is a directly applied force. Of course, utilizing suitable transducers, the mechanically detected pressure or pressure differential of the gas line can be converted into an electrical output which, in turn, can be transformed into a mechanical action upon the flow control element. This indirect control technique utilizes an electrical signal.

The gas flowing through the conduit can be conducted, according to the invention, through a measuring orifice across which the pressure differential is taken by the sensor. Depending upon the flow characteristics, the pressure differential will correspond to different flow values. For example, with pure turbulent flow, the volume rate of flow is proportional to the square root of the pressure differential. With pure laminar flow the volume rate of flow is proportional to the pressure differential. With a mixed flow having combined laminar and turbulent characteristics, the volume rate of flow is a combination of the two above-described relationships to the pressure differential.

In accordance with the invention, the control signal which is generated by the gas pressure sensor is either obtained from a measuring orifice or, in a simpler case, from the pressure upstream of the outlet or nozzle of the gas line. The latter procedure is possible and tolerable, if the pressure of the cobmustion site is approximately equal to the pressure of the ambient air or differs only slightly from it, respectively, and the pressure difference is established by employing the ambient air pressure as a secondary pressure instead of the pressure at the combustion site, which, of course, could be employed too.

In this case the outlet when the pressure at the combustion site is of the same order of magnitude as the air pressure, the outlet or nozzle of the gas line can be looked up as an orifice or constriction and the gas pressure measured upstream thereof with sufficient accuracy can be taken as the pressure difference across the gas nozzle or gas outlet.

According to a feature of the invention, the pressure sensor comprises a membrane which is subjected to a pressure differential and which will act on a flow control member within the air supply duct or within the flue gas duct, as e.g. rotable, swingable or slidable throttles or flaps.

According to another feature of the invention, the flow control element is a swingable flap which is suspended from a horizontal axis and the sensor comprises a control membrane disposed in a manometer housing, the membrane being subjected on one side to the pressure of the fuel gas and on the other side to the pressure of the incoming air or the pressure at the combustion site, the membrane being connected by a lever to the swingable flap. In this case the lever may be an arm connected directly to the flap so that its fulcrum lies at the flap pivot.

In another aspect of the invention, if the membrane is subjected to the pressure of the combustion zone, the sensor may additionally be provided with a compensating membrane ahead of the control membrane and coupled to the flap actuator. The compensating membrane is subjected on one side to the pressure in the combustion chamber and on the opposite side to the ambient or air pressure.

If the flow control element is a rotatable flap disposed in the air duct, it can be preceded in part by a disk disposed in the duct and forming a constriction and connected to a membrane of a manometer housing, the membrane thereby displacing both the disk and the rotatable flap.

In a further embodiment of the invention, the pressure sensor comprises a manometer housing first and second membranes in addition to a compensating membrane. The first membrane is subjected on one side to the fuel gas pressure and on its other side to the exhaust gas pressure downstream of the heat exchanger which abstracts the combustion heat. The second membrane is subjected on one side to the exhaust gas pressure downstream of the heat exchanger and on the opposite side to the pressure upstream of the heat exchanger. The compensating membrane is subjected on one side to the exhaust gas pressure upstream of the heat exchanger and on the opposite side to the exhaust gas pressure beyond the heat exchanger and a control element which responds to the membranes and varies the flow cross section of an outlet to the flue.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
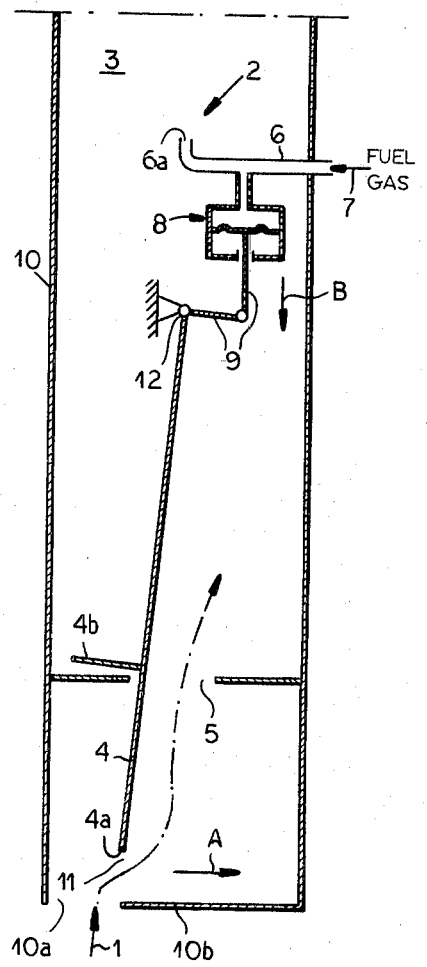
FIG. 1 is a diagram illustrating the principles of the present invention.

In FIG. 1 we have shown, highly diagrammatically, an apparatus utilizing the combustion of a fuel gas which is supplied at 7 from any conventional source through a supply conduit 6 to a nozzle 6*a* opening into a combustion chamber 3 which is ultimately connected to a flue and to any desired heat abstracting means. The combustion chamber 3 is the gas-burning site and this region can be considered an atmospheric gas consumer 2 which is supplied with the combustion air stream via a duct 10 through an intake opening 10*a*, the air stream being represented at 1.

A flow-control element 4 is provided to regulate the gas flow through a passage 5 and is swingable about a horizontal axis 12. The lower edge 4*a* defines a flow cross section 11 with the wall 10*b* of the duct adjacent to the intake 10*a* so that a pressure differential is applied across the member 4 tending to swing element 4 in the direction of arrow A when this pressure differential increases, thereby causing a closure 4*b* on member 4 to block the passage 5. The pressure differential, as will be discussed in greater detail below, thus applies a force in the direction of arrow A which represents a parameter of the combustion air stream 1.

In addition, the system comprises a gas-pressure sensor represented generally at 8 which responds to the pressure of the fuel gas in conduit 6 and acts upon the flow control member 4b by a transmission generally shown at 9 such that the force in the direction of arrow B increases with increasing fuel gas pressure.

The force components resulting from the forces in the direction of arrows A and B about the fulcrum of pivot 12 act counter to one another so that with increasing fuel gas pressure, the passage 5 tends to be opened and vice versa.

Figure 2:
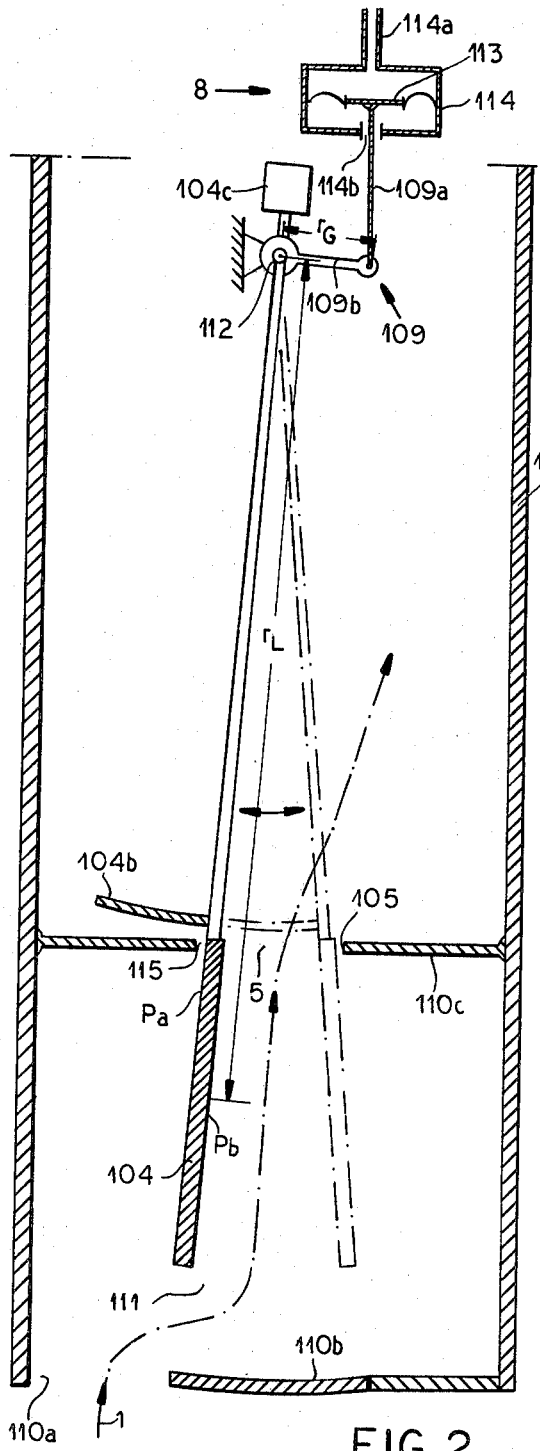
FIG. 2 is a section through a portion of a gas burner installation embodying the invention and drawn to a substantially larger scale than that of FIG. 1.

FIG. 2 shows structural details of the system diagrammatically represented in FIG. 1 and from FIG. 2 it will be apparent that the air-supply duct 110 has a partition 110c defining the passage 105 and that the wall 110b has the shape of a partial circular cylinder with its center of curvature at the fulcrum 112 so that the flow cross section 111 is constant in all positions of the swingable flap 104 which forms the flow-control element and carries the projecting portion 104b adapted to block the passage 105.

The device comprises a combustion installation for direct connection to a chimney, i.e. for connection without intervening valve members or the like so that the air flow is exclusively determined by the position of member 104, atmospheric pressure at the intake 110a, and the draft generated by the chimney, stack or flue.

Because the flow cross section 111 is effectively a constriction, the pressure $P_a$ or atmospheric pressure is applied to one surface of the plate constituting member 104 upstream of the partition 110c while a pressure $P_f$ which can be the flue generated pressure is applied to the opposite surface. The area of the plate is represented at $F_L$ and the differential pressure $\Delta P_L$ thereacross, equal to $P_a - P_f$ a function of the air throughput through the cross section 111.

The force tending to swing the flap 104 in a counterclockwise sense is thus equal to the product $\Delta P_L \cdot F_L$ and is effective at the center of the surface over a lever arm of length $r_L$.

The pressure sensor comprises a manometer housing 114 containing a control membrane 113 to which gas pressure ahead of the nozzle from the conduit is supplied via line 114a. In this case, the other side of the membrane may receive the pressure in the duct 110 via an opening 114b. As a result, a gas pressure differential $\Delta P_G$ is applied across the membrane 113 which has an effective surface area $F_G$, the product of these values giving the force applied to the mechanical transmission 109 which can include a rod 109a connected to the membrane 113 and pivotally connected to a lever arm 109b pivoted at 112 and affixed to the flap 104. The flap 104 can also carry a counterweight 104c.

These two forces are effective in opposite senses and by appropriate dimensioning of the length and size of the flap 104 and the membrane 113, that the position of the flap always assumes an equilibrium position corresponding to the relationship $$\Delta P_G \cdot F_G \cdot r_G = \Delta P_L \cdot F_L \cdot r_L$$

In this relationship:

$\Delta P_G$=The differential pressure of the gas as described above;

$\Delta P_L$=The differential pressure of the air across the constant cross section passage 11 or 111;

$F_L$=The effective area of the flap 4 or 104;

$F_G$=The effective area of the membrane 113;

$r_G$=The moment arm of the force $\Delta P_G \cdot F_G$;

$r_L$=The moment arm of the force $\Delta P_L \cdot F_L$.

The pressure on the underside of the membrane 113, taken downstream of the passage 11, corresponds essentially to the negative or draft pressure generated at the chimney.

A gap is provided at 115 to eliminate friction in the region of the passage 105 and should be as small as possible so that is has no significant effect on the air flow rate.

The rate $F_L$ and $F_G$ and the length of the lever arms $r_G$ and $r_L$ are so determined that at peak heat loading and minimum chimney draft the passage 5, 105 is fully open. Further the cross sections are established so that the desired air factor (ratio of air flow to gas flow) remains substantially constant in all positions of the flap.

Figure 3:
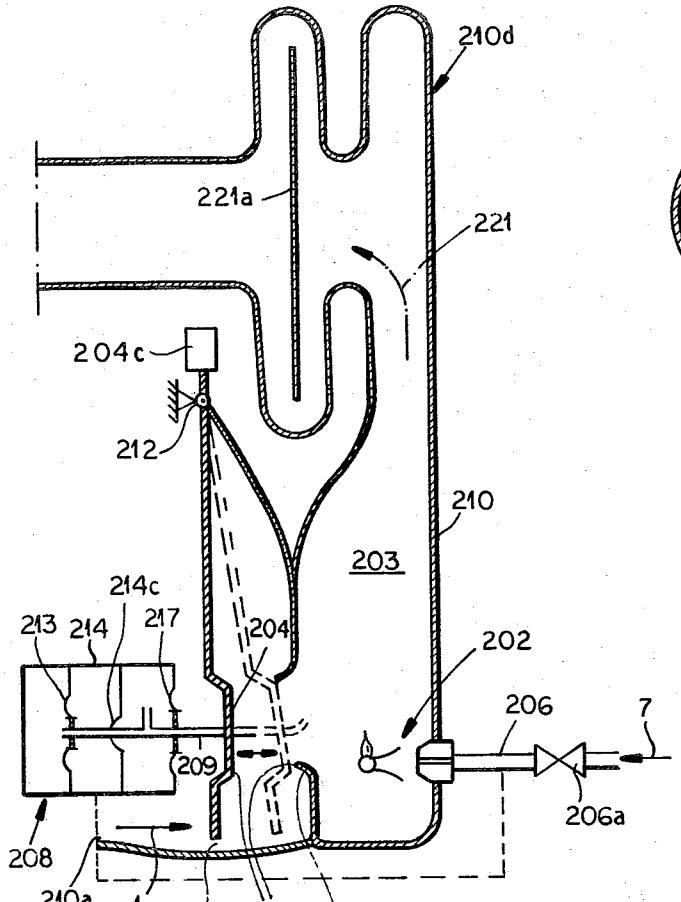
FIG. 3 is a section through another installation utilizing a direct chimney connection.

FIG. 3 shows, in highly schematic form, another gas fired unit, in this case a space heater with direct chimney connection and in which the air flow intake 210a is provided with a flow cross section 211 for the incoming air stream beneath the swingable flap 204 which is fulcrumed on a horizontal pivot 212 and carries a counterweight 204c as previously described.

In this embodiment, the housing 210 forms a combustion chamber 203 to which the gas is fed by a line 206 through a valve 206a, the gas feed being represented at 7. The housing 210 has an intake opening 216 which can be approached more or less closely by the flap 204 so that the flow cross section 205 of the air to enter the combustion chamber is varied.

The position of the flap 204 is determined by a manometer 208 having a control membrane 213, one side of which receives the pressure in the combustion chamber through the tubular transmission 209 between this membrane and the flap 204. A line 214a delivers the pressure from the gas conduit 206 to the other side of membrane 213 while a compensating membrane 217 is subjected to ambient air pressure on one side and to the draft or combustion chamber pressure through tube 209 on the opposite side. The housing 214 may have a partition 214c between the two membranes.

Consequently, the equivalent pressure differential resulting from the influx of the atmospheric air acts upon the flap 204 in the counterclockwise sense while the pressure of the gas in conduit 206 is transmitted from the membrane 213 via member 209 to the flap 204 tending to rotate in the clockwise sense and the aforementioned relationship applied in this embodiment as well. In addition, the compensating membrane 217 allows compensating for any suction force produced by the draft through the opening 216 which forms a stop ring for the flap 204, on the latter.

The exhaust gas passes as shown by the arrow 221 to the flue past a baffle 221a in the region 210d of the housing forming a heat exchanger with the surrounding space.

Figure 4:
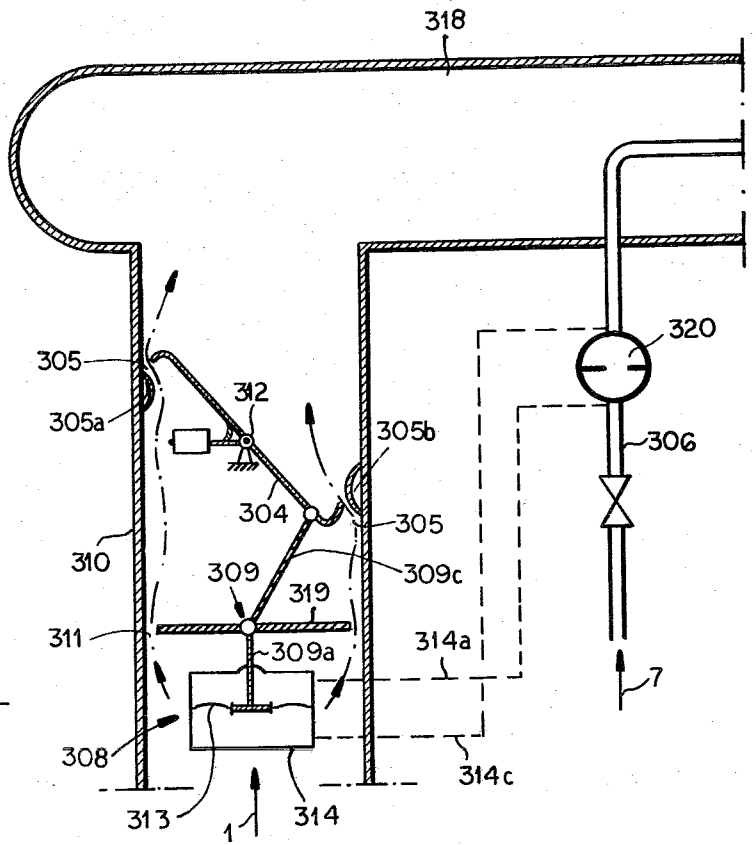
FIG. 4 is a section through still another installation with a rotatable flow control member.

In the embodiment of FIG. 4, which has a duct 318 running to an air blower feeding the combustion air to the combustion chamber (not shown) to which the gas is delivered via the conduit 306, a constriction disk 319 or other means is provided to create a pressure differential across a constant flow cross section 311.

This disk 319 thus is moved in response to the pressure differential in the air feed 1 and can be coupled by one member 309c of the transmission 309 to the pivotal flap 304, member 309c being a link pivotally connected to this flap and the disk.

The manometer 308 has a housing 314 which defines two compartments with the control membrane 313, the latter being connected by a member 309a of the transmission 309 to the rotatable flap 304 as well. The two compartments are connected by lines 314*a* and 314*c* across a measuring orifice 320 in the gas supply line. The measuring orifice generates the gas pressure differential which is related to the gas flow rate in the manner described so that once again the aforementioned equation applies and the force which is a parameter of the air flow rate is balanced by the force which is a parameter of the gas flow rate to determine the flow cross sections 305 admitting air to the duct 318. The assembly provided in the air intake duct 310 and the flap 304 is rotatable about a horizontal axis 312 and has a balancing weight 304*c*. The duct 310 can be provided with formations 305*a* and 305*b* whose configurations are such that they ensure uniform air flow through the cross sections 305 and hence any pressure differential produced by the air flow through these cross sections is in balance on opposite sides of the rotatable flap.

Figure 5:
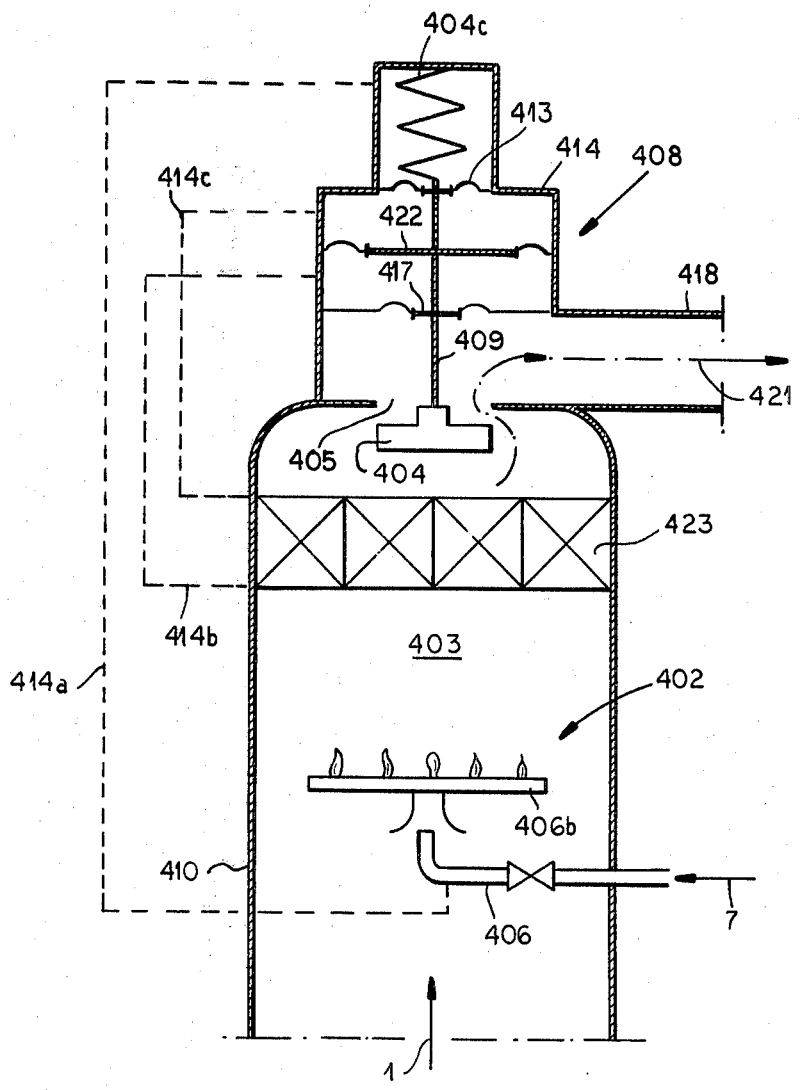
FIG. 5 is a section through a gas burner installation for use as a water heater with a direct chimney connection.

FIG. 5 shows a water heater with direct chimney connection for the exhaust gas 421, the housing leading to the combustion chamber forming an air flow passage as represented at 410. The combustion chamber 403 is provided above a burner 406*b* forming part of the gas consumer 402 and supplied with gas by the conduit 406 in the manner previously described.

At the upper end of the housing there is provided a heat exchanger 423 through which water can be passed to be heated by the combustion in chamber 403.

In this embodiment, a disk 404 forms a closure between the flue duct 418 and the heat exchanger 423 which has a free cross section 405. Member 404 is actuated via a transmission rod 409 by a manometer 408 whose housing 414 is provided with three membranes 413, 422 and 417, and with a spring 404*c* balancing the weight of member 404.

One side of the uper membrane 413 receives the gas pressure via line 414*a* while the opposite side of this membrane receives the exhaust gas pressure on the downstream side of the heat exchanger 423 by a line 414*c*.

The membrane 422 is pressurized on one side at the exhaust gas pressure downstream 423 via line 414*c* and on its opposite side by the exhaust gas pressure upstream of the heat exchanger 423 via line 414*d* so that the pressure differential across the heat exchanger is applied to membrane 422.

One side of the compensating membrane 417 is at the flue pressure while the opposite side is at the pressure in the combustion chamber 403 via line 414*d*.

This arrangement allows compensation for the effect of the pressure differential across the heat exchanger 423 and the flue pressure upon member 404 which otherwise responds in the manner described to a parameter of the air flow and to the gas pressure.

It is apparent that this arrangement utilizes as a flow meter the heat exchanger since the pressure drop across the heat exchanger is a function of the volume rate of flow therethrough and hence no separate flow meter is required. The invention has an advantage over earlier control systems in that it is possible to keep the air/fuel ratio more accurately constant and maintain its consistency better under both laminar and turbulent flow conditions.

Control with load changes is more effective as well because the temperature of the exhaust gas increases with increasing loading and the flow resistance for a given volume rate of flow increases in proportion to the 1.8 power of the exhaust gas temperature. In this case, the heat exchanger acts similarly to a flow resistance with turbulent flow characteristics. The flow characteristics can be changed as desired by corresponding shaping of the gas outlet, e.g. by forming it as an elongated outlet.

We claim:

1. A gas burner installation comprising:

housing means formed with an air intake at atmospheric pressure, a combustion chamber, a passage connecting said intake with said combustion chamber and a passage connected to said combustion chamber for discharging combustion gases;

a gas-supply conduit opening into said housing in the region of said combustion chamber for supplying fuel gas thereto;

a flow-control member cooperating with one of said passages and displaceable to control the air flow from said intake to said combustion chamber, said member being provided with means for displacing said member as a function of the air flow rate;

sensing means responsive to the gas pressure in said conduit; and means connected to said sensing means for displacing said member so as to maintain a substantially constant ratio of air to fuel gas supplied to said combustion chamber, said flow-control member being a swingable flap disposed in said passage between said intake and said combustion chamber, said sensing means comprising a manometer housing having a control membrane pressurized on one side by said gas pressure and on an opposite side by the pressure of the combustion air, said means connected to said sensing means including an element connected to said membrane and a lever connected to said flap and said element.

2. A gas burner installation comprising:

housing means formed with an air intake at atmospheric pressure, a combustion chamber, a passage connecting said intake with said combustion chamber and a passage connected to said combustion chamber for discharging combustion gases;

a gas-supply conduit opening into said housing in the region of said combustion chamber for supplying fuel gas thereto;

a flow-control member cooperating with one of said passages and displaceable to control the air flow from said intake to said combustion chamber, said member being provided with means for displacing said member as a function of the air flow rate;

sensing means responsive to the gas pressure in said conduit; and means connected to said sensing means for displacing said member so as to maintain a substantially constant ratio of air to fuel gas supplied to said combustion chamber, said flow-control member being a swingable flap disposed in said passage between said intake and said combustion chamber, said sensing means comprising a manometer housing having a control membrane pressurized on one side by said gas pressure and on an opposite side by the pressure in said combustion chamber, said means connected to said sensing means including an element connected to said membrane and a lever connected to said flap and said element.

* * * * *